US005540330A

United States Patent [19]

Lo Duca

[11] Patent Number: 5,540,330

[45] Date of Patent: Jul. 30, 1996

[54] BOX WITH RETENTION AND PROTECTION ELEMENT FOR A JAR

[75] Inventor: Carmelo Lo Duca, Milan, Italy

[73] Assignee: GI.BI.EFFE S.R.L., Milan, Italy

[21] Appl. No.: 299,415

[22] Filed: Sep. 1, 1994

[30] Foreign Application Priority Data

Sep. 10, 1993 [IT] Italy ..... MI93A1958
Nov. 12, 1993 [IT] Italy ..... MI93A2420

[51] Int. Cl.[6] ..... B65D 85/44

[52] U.S. Cl. ..... 206/446; 206/485; 206/590

[58] Field of Search ..... 206/45.14, 45.19, 206/320, 446, 485, 485.1, 521, 586, 587, 588, 590–594

[56] References Cited

U.S. PATENT DOCUMENTS 3,158,307 11/1964 Mayer .
3,438,482 4/1969 Hamilton .

FOREIGN PATENT DOCUMENTS 2445790 4/1976 Germany .
2154213 9/1985 United Kingdom .

*Primary Examiner*—Jimmy G. Foster
*Attorney, Agent, or Firm*—Oblon, Spivak, McClelland, Maier, & Neustadt, P.C.

[57] ABSTRACT

A box with elongate flaps is folded in the interior of the box and serve as a support and protection element for an item such as a jar to be positioned therein. The box is in a form of a single piece of cardboard or other material, the box being able to retain and effectively protect the jar or similar item within the box and being of low cost and of easy assembly at the moment of making up the package. The box is formed of a sheet of flexible material provided with four consecutive main panels separated from each other by parallel fold lines, with flaps and, for forming two ends of the box, with two respective closure panels projecting from free ends of the main panels and separated from them by fold lines perpendicular to those separating the panels from each other.

4 Claims, 3 Drawing Sheets

BOX WITH RETENTION AND PROTECTION ELEMENT FOR A JAR

BACKGROUND OF THE INVENTION

1. Field of the Invention

This invention relates to a box with a retention and protection element for a jar housed in the box.

2. Discussion of the Background

Boxes of cardboard or other material are often used for housing jars or bottles containing the most diverse products, such as creams, ointments, medicaments etc.

In many cases the jars have to be securely retained and protected against impact and the like. In this case the jar is placed in a cavity or seat provided in a block of soft material, such as expanded polystyrene, which is inserted into the box. It is also known to insert into the box a supplementary structure, sometimes formed of the same material as the box, its purpose being to maintain the jar spaced from the side and/or base walls of the box.

It is apparent that the use of a structure formed separately from the box and arranged to protect the jar in its box is costly and requires the use of special machines for inserting the structure into the box and then to house the jar inside the structure.

SUMMARY OF THE INVENTION

The main object of the present invention is to provide a box in the form of a single piece of cardboard or other material, the box being able to retain and effectively protect an item to be protected such as a jar within the box and being of low cost and easy assembly at the moment of making up the package.

This and further objects are attained by a box with at least one retention and protection element for a jar or the like, formed from a sheet of flexible material, in particular cardboard, provided with four consecutive main panels separated from each other by parallel fold lines, with flaps and, for forming the two ends of the box, with two respective closure panels projecting from the free ends of the main panels and separated from them by creasing or fold lines perpendicular to those separating the panels from each other, characterised in that from two separate main panels between which there is interposed a further main panel there project from at least one and the same side of the panels two elongate flaps in each of which there are provided two supplementary fold lines parallel to the fold line which separates said flap from the main panel from which it projects, in each elongate flap there being provided an intermediate fold line between said supplementary fold lines and parallel to them, within the box formed from said cardboard sheet said two elongate flaps being folded over along their respective fold lines, with one of their portions being fixed to the interior of the main panel from which said flap projects to form a support for supporting a jar, which is kept raised from the adjacent end of the box.

Preferably, said elongate flaps each extend to form an appendix which can be folded over about a further fold line to be superposed on the remaining part of said flap within the finished box, in this appendix there being provided fold lines which are substantially superposed on fold lines of the elongate flaps when said appendices have been folded over onto the respective elongate flaps.

Again preferably, in each of said elongate flaps there is provided a profiled aperture located between said supplementary fold lines of said flap, said intermediate fold lines intersecting the respective apertures which form a housing for said jar, which is retained raised from the adjacent end of the box and spaced from the side walls of said box.

BRIEF DESCRIPTION OF THE DRAWINGS

The structure and characteristics of the box will be more apparent from the description of two preferred embodiments thereof given hereinafter by way of non-limiting example with reference to the accompanying drawings, in which.

DESCRIPTION OF THE PREFERRED EMBODIMENTS

Figure 1:
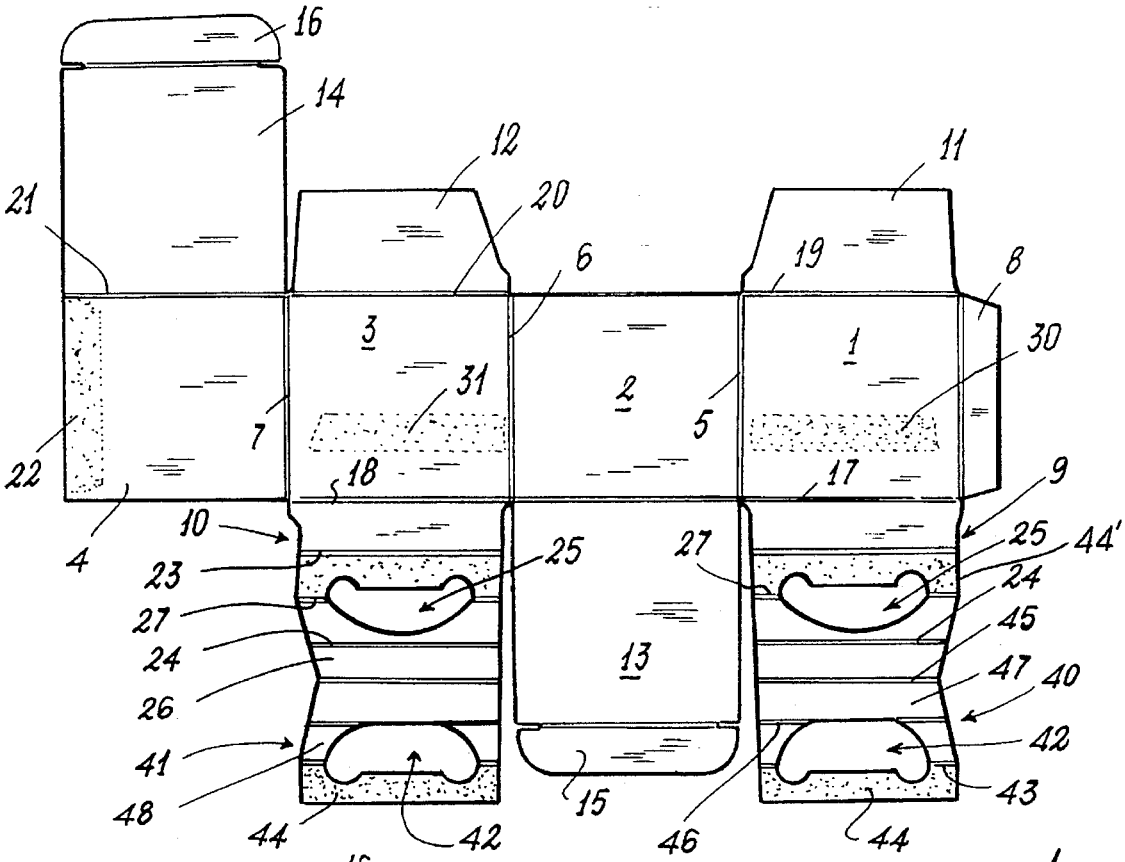
FIG. 1 is a plan view of a punched cardboard sheet usable for forming the box.

With reference firstly to FIG. 1, this shows a plan view of a cardboard sheet comprising four consecutive main panels 1, 2, 3, 4 separated from each other by parallel creasing or fold lines 5, 6, 7 (from the panel 1 there projects a flap 8 separated from the panel 1 by a creasing or fold line parallel to the lines 5–7). From the free ends of the main panels there project flaps 9, 10, 11, 12 and, respectively, closure panels 13, 14 provided with foldable edges 15, 16, said flaps and closure panels being separated from the respective main panels by fold lines 17–21 perpendicular to the creasing lines 5–7.

To form the box the various panels are folded about their respective fold lines and the flap 8 is glued to the inner surface of the panel 4 onto the region indicated by reference numeral 22 in FIG. 1.

As can be seen from the drawings, in each of the two flaps 9, 10 there are provided two supplementary fold lines 23, 24 parallel to the fold lines 17, 18, between said supplementary creasing fold lines 23, 24 there being provided in each flap a profiled aperture 25, that edge thereof facing the free end 26 of the respective flap being of circular arc profile, ie complementary to that of the outer lateral portion of a jar to be contained and protected within the box, the jar being assumed to be of circular cross-section.

Finally it can be seen that in each flap 9, 10 there is provided an intermediate fold line 27 (parallel to the lines 23, 24) which intersects the respective profiled aperture 25. Thus, an intermediate flap support portion 44' is defined between the intermediate fold line 27 and the supplemental fold line 23 in each flap, the purpose of which is discussed hereinbelow.

Figure 5:
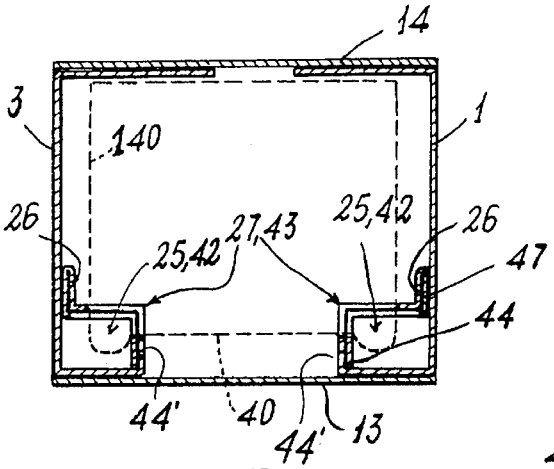
FIG. 5 is a cross-section through the finished closed box on the line 5—5 of FIG. 4.

From the flaps 9 and 10 there extend appendices 40, 41 in which there are provided supplementary profiled apertures 42 (of shapes and dimensions substantially equal to those of the apertures 25) intersected by additional fold lines 43 which delimit a free end edge 44 of each appendix separated from the flap from which it extends by a further fold line 45. A fold line 46 is also provided which (with the fold lines 43 and 45) delimits appendix portions indicated by the reference numerals 47 and 48. Upon assembly of the box, edge 44 is oriented parallel to and is overlapped with intermediate flap support portion 44' that forms a hollow support structure and provides extra support for a jar 140 (as shown in FIG. 5) positionable within the box.

Figure 2:
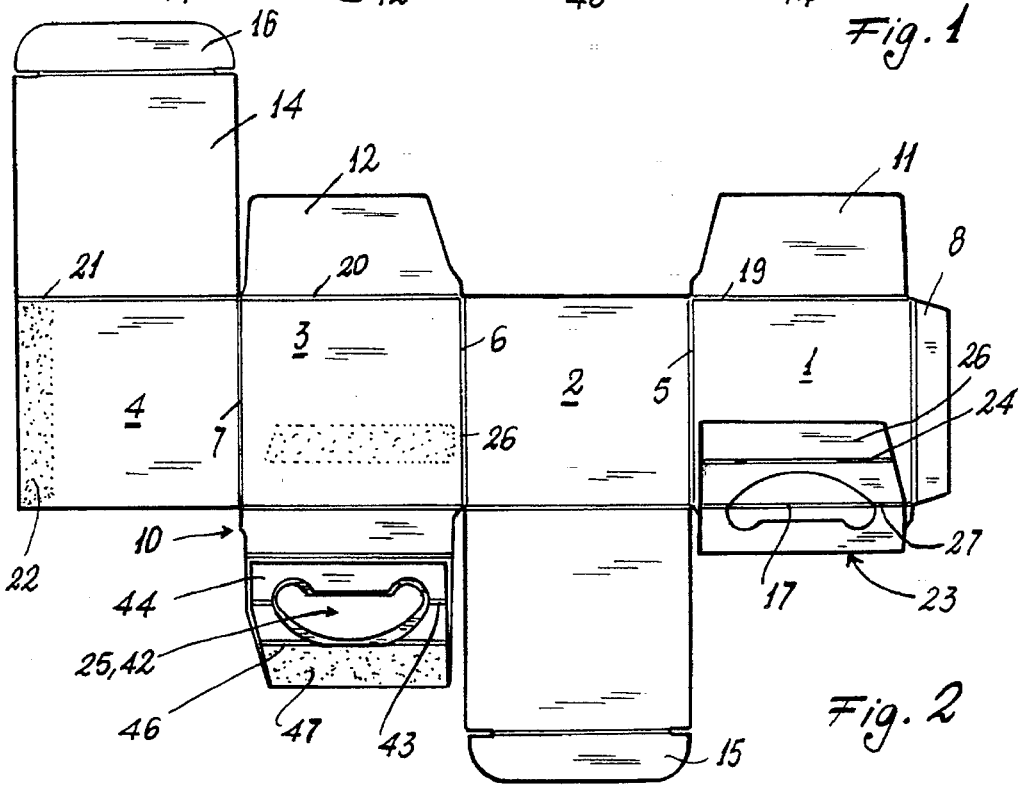
FIG. 2 shows the cardboard sheet of FIG. 1 partly folded in a first stage of assembly.

To form the box from the cardboard sheet heretofore described, the appendices 41, 42 are firstly folded about the respective fold lines 45 so that they become superposed on the respective flap from which they extend, as shown in the bottom left part of FIG. 2. It can be seen that when in this condition the apertures 42 are substantially superposed on the respective apertures 25, and the fold lines 34 and 46 are superposed on the fold lines 23 and 24 respectively.

Following this (as can be seen in the lower right part of FIG. 2), the flaps 9, 10 are folded about the fold lines 23 and the portions 47 of the appendices (which are superposed on the flap portions 26) are fixed (by gluing) onto the regions indicated by reference numerals 30 and 31 (FIG. 1) on the inside of the respective main panels 1, 3. At the same time as (or following) said fixing of the flaps onto the regions 30, 31 of the panels 1, 3, glue can be applied for fixing the flap 8 onto the region 22 of the panel 4, after the cardboard sheet has been folded back on itself about the fold lines 5 and 7 (FIG. 3).

Figure 3:
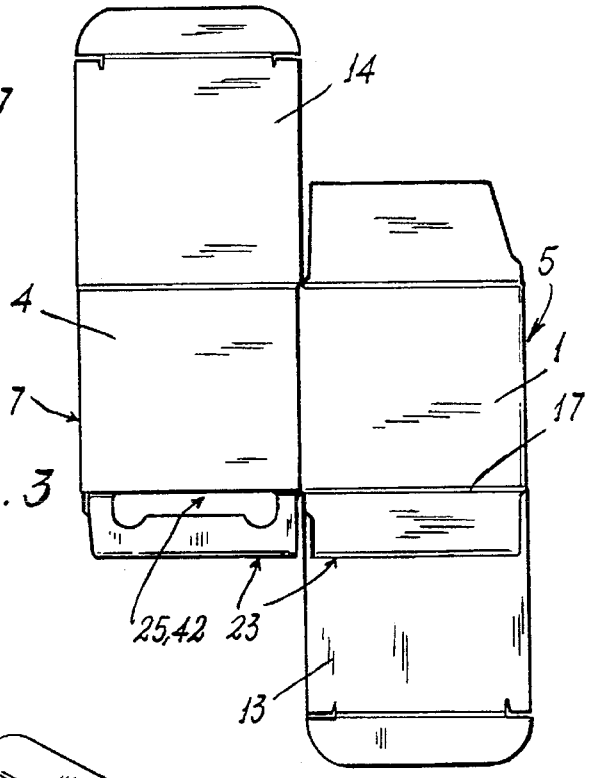
FIG. 3 shows the cardboard sheet of FIG. 2 in a subsequent stage of assembly.

The initial assembly of the box is thus terminated, and packs of open boxes such as that shown in FIG. 3 can be packaged and despatched to the final box user.

Figure 4:
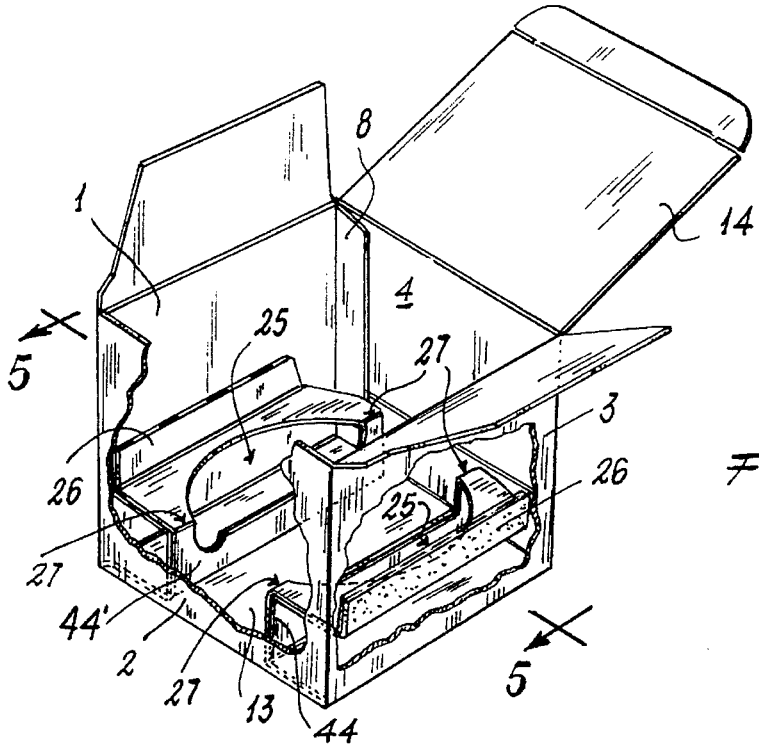
FIG. 4 is a perspective view of the formed box with its lid open, a portion of the box walls having been removed to show the box interior.

When the user receives the pack of flat preformed boxes with their ends open (FIG. 3), he opens the box by pressing against the fold lines 5 and 7 to cause the panels 1–4 to assume a quadrangular arrangement with right angled corners. By then pressing against the fold lines 23 he makes the flaps 9, 10 assume an "open" arrangement (FIGS. 4 and 5) in which they are retained by the bottom end panel 13 when it is closed in the traditional manner. In this open arrangement, the apertures 25, 42 (superposed on each other) face towards the interior of the box, one facing the other to define a seat which can house and securely retain a jar or bottle 140 (shown by dashed lines in FIG. 5), the base of which rests on the rectilinear edge of each of the two apertures.

As a result the jar 140 is not only securely retained within the box but is protected from impact and damage by being kept spaced from the lateral and end walls of the box by the flaps 9, 10 onto which the respective appendices 40, 41 have been folded back and superposed. It follows from this structure that the thickness of the cardboard at the seat housing the bottle is greatly reinforced by the presence of the appendices 40, 41 superposed on the flaps 9, 10, so providing considerable and effective low-cost protection for the bottle contained in the box.

It should also be noted that the aforedescribed box can be made up at high speed with traditional machines and does not require the use of any supplementary element for retaining and protecting the jar within the box.

In the illustrated box a seat for the jar is provided only in correspondence with the box base, however it is apparent that a similar seat can also be provided corresponding with the box lid.

Figure 6:
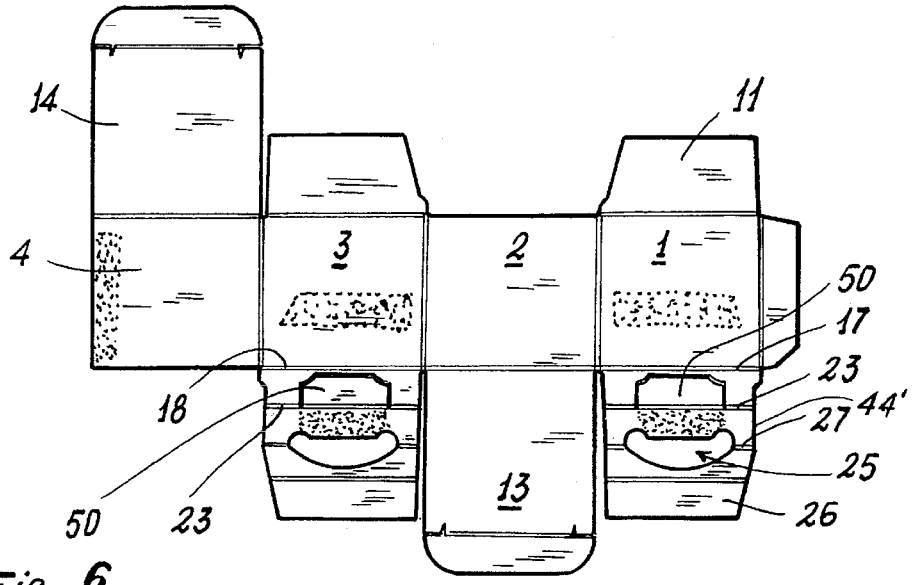
FIG. 6 is a plan view of a different cardboard sheet usable for forming a different embodiment of the box.
Figure 7:
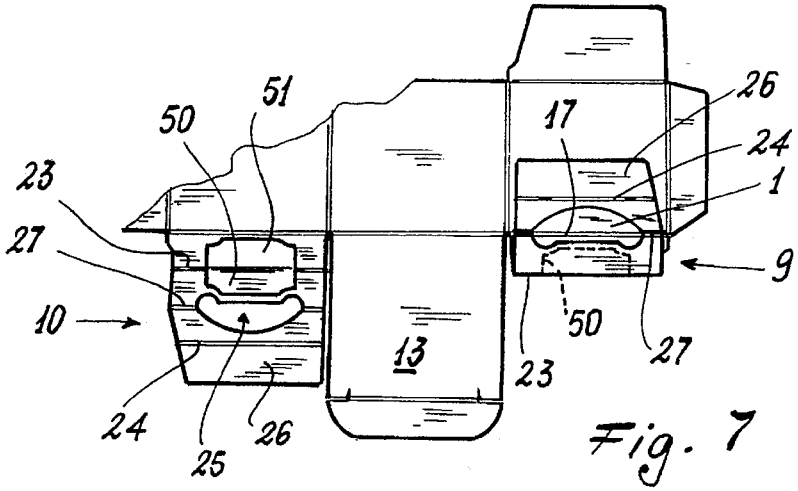
FIG. 7 shows the cardboard sheet of FIG. 6, but with some of its portions folded, in intermediate stages in the formation of the box.
Figure 8:
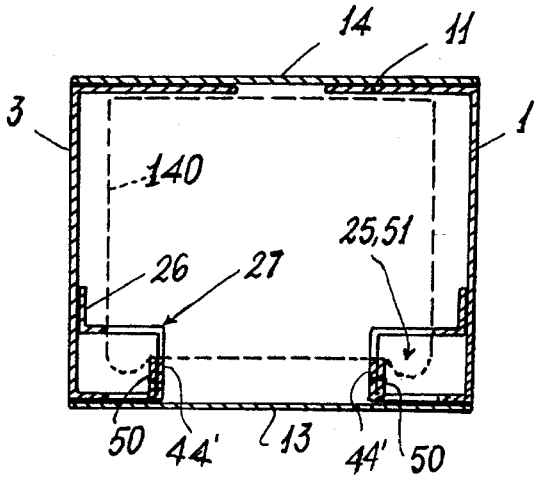
FIG. 8 is a cross-section through the box obtained in this manner, shown closed and housing a bottle.

The box embodiment shown in FIGS. 6 to 8 is similar to the already described box, and differs from it only by the different shape of the flaps which are to form the seat for the bottle or jar to be housed in the box. As many as possible of the reference numerals already shown in FIGS. 1 to 5 will be used for brevity of description.

As can be seen from the drawing, in this modified embodiment of the box the appendices 40 and 41 on the flaps 9, 10 are not provided.

Instead, in each flap, in a region lying between the fold lines which separate these flaps from the respective main panels and the fold lines on the flaps themselves there is provided a substantially C-shaped cut, the ends of which terminate at the supplementary fold lines 23 to define a tab 50 which can be folded back about said supplementary fold line 23 to be superposed on the adjacent flap 44 portion lying between the fold lines 23, 27, as can be clearly seen from the lower left part of FIG. 7.

It should be noted that the shape and dimensions of the tabs 50 are such that when these have been folded back in the stated manner they expose a hole 51 which leaves the aperture 25 completely free when the flap is subsequently folded back onto itself about the fold line 23 (lower right part of FIG. 7).

In addition, in the box when shaped and finished, the tabs 50 lie to the side of those flap portions (in correspondence with the apertures forming the housing seats for the bottles) which are adjacent and perpendicular to the bottom end wall 13 of the box and intended to support the bottle weight, thus considerably strengthening the structure of the box at said seats.

The described boxes comprise apertures 25, 42, 51 (for defining a housing seat for the jar) and appendices 40, 41 extending from the respective flaps (for strengthening those flap portions which are to support the weight of the bottle when housed in the box).

It is however to be understood that while the presence of said appendices 40, 41 is preferred (especially if the bottles are relatively heavy), thus is not strictly necessary. In the same manner the presence of the apertures 25, 42, 51 is not necessary if the bottle is merely to be isolated from the bottom wall of the box.

In any event it is apparent that the aforedescribed boxes are of low production cost, can be made up at high speed using traditional machines and do not require the use of any supplementary element for retaining and protecting the jar within the boxes.

The box embodiments described with reference to the drawings comprise elongate flaps only in correspondence with one of the box openings, namely at its lower end. It is however apparent that similar flaps can also be provided in correspondence with the top or lid of the box, so that a jar housed within it can be securely retained and protected at both ends.

What is claimed is:

1. A box with at least one retention and protecting element for an item adapted to be enclosed therein, the box being formed from a sheet of flexible material, which comprises:

four connected main panels respectively separated from each other by a first plurality of parallel fold lines, the sheet including a plurality of first flaps and closure panels respectively projecting from free ends of the main panels and separated therefrom by a second plurality of fold lines respectively substantially perpendicularly positioned with respect to said first plurality of fold lines;

two of said first flaps comprising elongate flaps respectively projecting from one side of two of said main panels, each of said elongate flaps being provided with two supplementary fold lines substantially parallel to the second fold lines, said elongate flaps each being provided with an intermediate fold line located between said supplementary fold lines and parallel thereto, said two elongate flaps being respectively folded over two of said second fold lines, and one portion of each of said elongate flaps being respectively fixed to an interior portion of the main panels such that said elongate flaps form a hollow supporting structure that is adapted to support the item to be enclosed in the box and keep the item raised from an adjacent end of the box;

said elongate flaps each having a foldable appendix which is folded and overlaps at least an upright portion of the supporting structure such that said appendix is adapted to assist said supporting structure in supporting the item in the box.

2. A box as claimed in claim 1, wherein said elongate flaps comprise a further fold line wherein each said appendix extends from said elongate flaps and is foldable over said further fold line so as to be superposed on a remaining portion of said elongate flap within the box and wherein in each said appendix additional fold lines are provided which are respectively substantially superposed on the supplementary fold lines of the respective elongate flaps when each said appendix has been folded over the respective elongate flaps.

3. A box as claimed in claim 1, wherein in each of said elongate flaps, an aperture is provided located between said supplementary fold lines of said elongate flaps, said intermediate fold lines intersecting the aperture and forming a housing for said item enclosed in the box, said item being retained raised from an adjacent end of the box and spaced from side walls of said box formed by the main panels.

4. A box as claimed in claim 1 wherein in each of said elongate flaps there is provided an aperture and said intermediate fold line intersects said aperture so that a portion of the item is positionable in said aperture.

* * * * *